US011104564B2

(12) United States Patent
Becchi et al.

(10) Patent No.: US 11,104,564 B2
(45) Date of Patent: Aug. 31, 2021

(54) SYSTEM AND METHOD FOR SEALING CONTAINERS, BOTTLES, FLASKS AND THE LIKE

(71) Applicant: EMMETI S.p.A., Reggio Emilia (IT)

(72) Inventors: Roberto Becchi, Reggio Emilia (IT); Luca Ugoletti, Reggio Emilia (IT)

(73) Assignee: EMMETI S.p.A., Reggio Emilia (IT)

( * ) Notice: Subject to any disclaimer, the term of this patent is extended or adjusted under 35 U.S.C. 154(b) by 559 days.

(21) Appl. No.: 15/334,731

(22) Filed: Oct. 26, 2016

(65) Prior Publication Data

US 2017/0113910 A1 Apr. 27, 2017

(30) Foreign Application Priority Data

Oct. 27, 2015 (IT) ..... 102015000065821

(51) Int. Cl.

| | |
|---|---|
| ***B67B 5/05*** | (2006.01) |
| ***B65B 43/46*** | (2006.01) |
| ***B05C 9/12*** | (2006.01) |
| ***B05C 3/20*** | (2006.01) |
| ***B05C 3/18*** | (2006.01) |

(52) U.S. Cl.

CPC ..... *B67B 5/05* (2013.01); *B65B 43/46* (2013.01); *B05C 3/18* (2013.01); *B05C 3/20* (2013.01); *B05C 9/12* (2013.01)

(58) Field of Classification Search

CPC .. B67B 5/00; B67B 5/03; B67B 5/038; B67B 5/05; B05C 9/12; B05C 9/14; B05C 3/00–02; B05C 3/09; B05C 3/10; B05C 3/18; B05C 3/20

See application file for complete search history.

(56) References Cited

U.S. PATENT DOCUMENTS

| | | | | |
|---|---|---|---|---|
| 1,517,310 A * | 12/1924 | Mortensen | ..... | B67B 5/05 118/423 |
| 1,708,429 A | 4/1929 | Mueller et al. | | |
| 5,509,965 A * | 4/1996 | Harry | ..... | B05C 3/10 118/423 |

(Continued)

FOREIGN PATENT DOCUMENTS

| | | |
|---|---|---|
| FR | 2 698 088 A | 5/1994 |
| WO | 02/060804 A2 | 8/2002 |

OTHER PUBLICATIONS

Italian Search Report for Italian Patent Application No. UB20154913 dated Jun. 27, 2016, 7 pgs.

*Primary Examiner* — Dah-Wei D. Yuan
*Assistant Examiner* — Stephen A Kitt
(74) *Attorney, Agent, or Firm* — Merchant & Gould P.C.

(57) ABSTRACT

A system for sealing containers includes a first conveyor of containers to convey containers from an inlet zone to a sealing zone. A first processing station of containers applies a layer of sealing material to at least one end portion of each container. A second processing station polishes the layer of sealing material applied by the first processing station. A first moving unit of containers moves containers from the first conveyor to the first processing station and moves containers with a layer of sealing material from the first processing station to the second processing station. A second conveyor conveys containers from the sealing zone to an outlet zone. A second moving unit moves containers with a layer of sealing material from the second processing station to the second conveyor.

19 Claims, 7 Drawing Sheets

(56) References Cited

U.S. PATENT DOCUMENTS

| | | | | |
|---|---|---|---|---|
| 5,658,619 | A * | 8/1997 | Kirschner | B05C 3/10 118/423 |
| 2004/0089231 | A1 * | 5/2004 | Gilmore | B05C 3/02 118/425 |
| 2017/0113910 | A1 * | 4/2017 | Becchi | B67B 5/05 |

* cited by examiner

SYSTEM AND METHOD FOR SEALING CONTAINERS, BOTTLES, FLASKS AND THE LIKE

This application claims benefit of Serial No. 102015000065821, filed 27 Oct. 2015 in Italy and which application is incorporated herein by reference. To the extent appropriate, a claim of priority is made to the above disclosed application.

FIELD OF THE INVENTION

The present invention relates to a system and method of sealing containers, bottles, flasks and the like.

TECHNICAL BACKGROUND

As it is known, upon bottling bulk products such as wines and liquors in bottles or flasks and then applying the cap, the sealing of the tops of the bottles or flasks may sometimes be carried out applying a sealing material (e.g. wax), the inviolability of which provides the guarantee that the cap has not been tampered and the content of the bottle or flask has not been altered.

The application of wax to the top of the bottles or flasks may be carried out manually by immersing an end portion of the neck in a tank containing wax maintained in the molten (liquid or semi-liquid) state, by keeping the neck immersed for a time sufficient to ensure the application of the wax to the end portion immersed, and then extracting the bottle or flask from the tank.

Such an operation may also be carried out automatically by using a special machine equipped with a movable support in which one or more bottles or flasks to be sealed may be accommodated. The movable support is adapted to immerse the end portion of the neck of the bottles or flasks in a tank containing wax in the molten (liquid or semi-liquid) state, located below the movable support, to rotate each bottle or flask about its longitudinal axis, to keep the neck immersed and rotating for a time sufficient to ensure the application of the wax, and to extract the bottles or flasks from the tank by stopping the rotation of each bottle.

In both methods described above (manual and automatic), once each bottle or flask has been extracted from the wax-containing tank, the neck is coated with a layer of wax which forms, when in contact with air at room temperature and once hardened, a compact wax layer.

Following the wax application, performed either manually or automatically, the sealing of bottles or flasks may include polishing the compact waxing layer applied to the neck of each bottle or flask, in order to finish and improve the aesthetic appearance of the sealing itself.

The polishing operation is usually carried out manually by immersing the neck of each bottle or flask in cold water, drying the neck with a dry cloth, possibly shaking for a few moments the bottle or flask, and finally flaming the surface of the wax with a blowtorch to cause a surface melting thereof.

This polishing operation obviously entails rather long execution times also due to the fact that the bottles or flasks must be handled with special care in order to avoid the compact wax layer applied to the neck from scratching or damaging or even the bottle from breaking.

The lengthening of the execution times also inevitably impacts on the production costs and the profitability of the production process, especially on large scale.

Furthermore, at first sight, the polished bottles appear all substantially equal. However, the compact wax layer very often has a different sheen from bottle to bottle, which may be a not always acceptable aesthetic defect, especially if the bottles are sold or distributed wholesale.

SUMMARY

It is the object of the present invention to devise and provide a system and method of sealing containers, bottles, flasks and the like, which allows to obviate at least partially the drawbacks complained above with reference to the prior art.

The present invention also relates to a method of sealing containers, bottles, flasks and the like.

BRIEF DESCRIPTION OF THE DRAWINGS

Further features and advantages of the system and method according to the invention will become apparent from the following description of preferred embodiments, given by way of indicative and non-limiting example, with reference to the accompanying drawings, in which.

DETAILED DESCRIPTION

Figure 1:
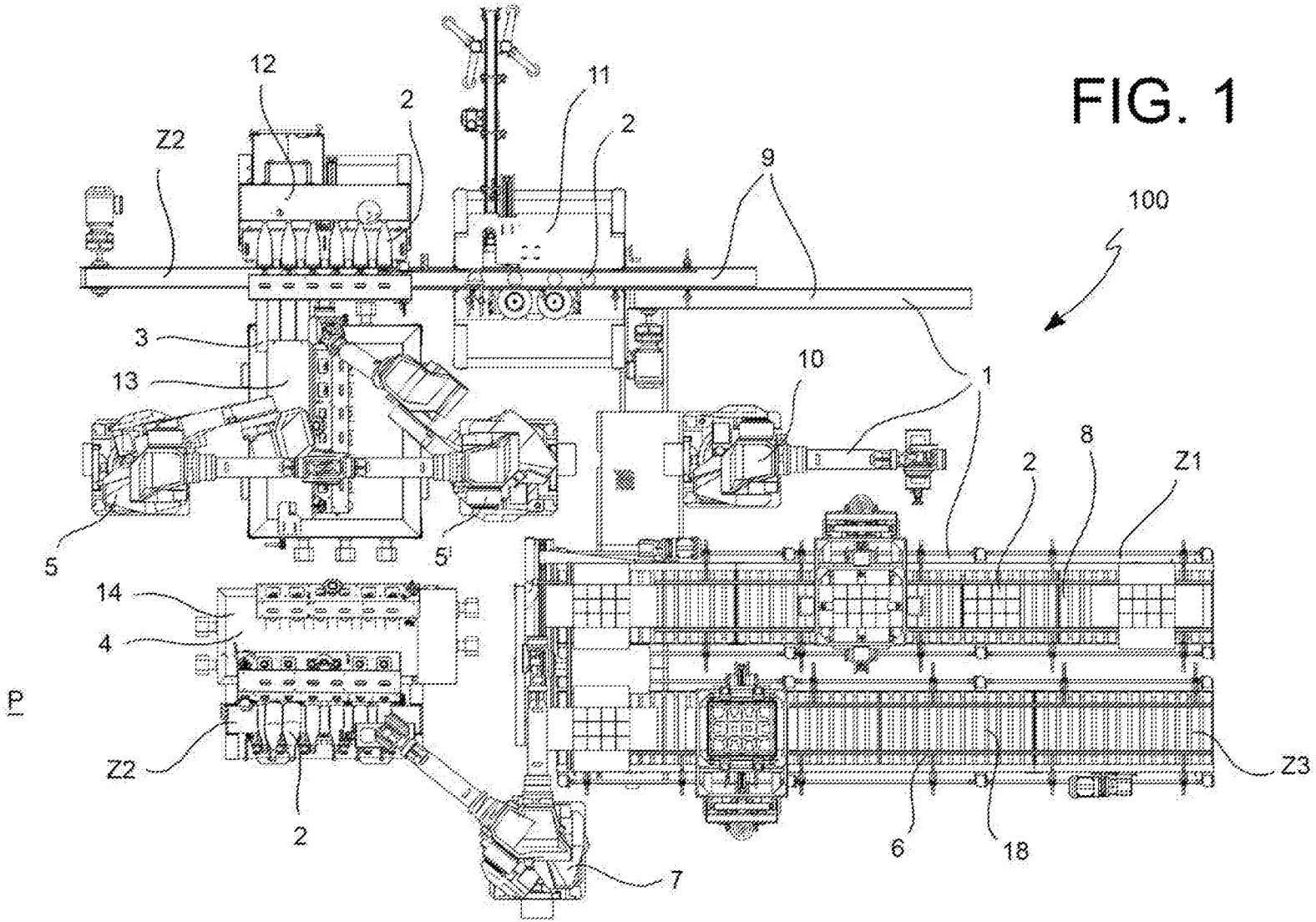
FIG. 1 diagrammatically shows a top view of a system for sealing containers, bottles, flasks and the like, according to one embodiment of the invention.

With reference to the above figures, numeral 100 denotes a system as a whole for sealing containers such as bottles, flasks, and the like, also referred to as sealing system or simply system below, according to one embodiment of the present invention.

It is worth noting that in the figures the same or similar elements have been denoted by the same numeric or alphanumeric references.

For the purpose of the present description, containers mean any container made of glass, plastic or other material, adapted to accommodate bulk food and other products therein, such as wine, liquors or drinks, the closure of which requires the application of a cap, lid or capsule, the subsequent sealing thereof may be required in order to ensure integrity and safety. Examples of containers of the above type are bottles, large bottles, flasks, vials, jars, phials, ampules, and so on.

In the figures, by way of example, the containers are bottles.

Returning to the embodiment of the figures, the system 100 comprises first conveyor means 1 of containers configured to convey a plurality of containers 2 from an inlet zone Z1 of the system 100 to a sealing zone Z2 of the containers.

Inlet zone Z1 means a zone where the containers are loaded, whereas sealing zone Z2, downstream of the inlet zone Z1, means the zone where each container loaded in the system 100 is processed to obtain the sealing thereof.

The system 100 further comprises a first processing station 3 of containers, hereinafter also only referred to as a first processing station, configured to apply a layer of sealing material to at least one end portion of each container of said plurality of containers 2 provided by the first conveyor means 1.

Sealing material means any material adapted to take a molten state when heated and a solid state when at room temperature. Examples of sealing materials are wax, sealing wax, shellac, and so on.

The system 100 further comprises a second processing station 4 of containers, hereinafter also only referred to as a second processing station, configured to polish the layer of sealing material applied by the first processing station 3 to said at least one end portion of each container of the plurality of containers 2 provided by the first conveyor means 1.

The system 100 further comprises a first moving unit 5 of containers, hereinafter also only referred to as a first moving unit, configured to move a plurality of containers 2 from said first conveyor means 1 of containers to the first processing station 3.

The first moving unit 5 is further configured to move a plurality of containers 2 from the first processing station 3 to the second processing station 4, on the at least one end portion of which the layer of sealing material has been applied.

The system 100 further comprises second conveyor means 6 of containers for conveying a plurality of containers 2 from the sealing zone Z2 of the containers to an outlet zone Z3 of the system 100.

Outlet zone Z3 means a zone in which the sealed containers are unloaded from the system 100.

The system 100 further comprises a second moving unit 7 of containers, hereinafter also only referred to as a second moving unit, configured to move a plurality of containers 2 from the second processing station 4 to said second conveyor means 6 of containers, on the at least one end portion of which the layer of sealing material applied has been polished.

Returning to the first conveyor means 1 of containers, in the embodiment of the figures, they comprise a first conveyor 8, for example a roller set or a conveyor belt, configured to convey a plurality of containers 2 divided in groups from the inlet zone Z1 of the system 100, each preferably accommodated within a respective box or carton.

Moreover, the first conveyor means 1 of containers comprise a second conveyor 9 configured to convey each container towards the sealing zone Z2 of the containers with a rhythmic pace.

In this regard, the first conveyor means 1 of containers comprise a third moving unit 10 of containers, hereinafter also referred to as a third moving unit, configured to pick up the plurality of containers 2 from the first conveyor 8 and arrange the containers of the plurality of containers 2 in a row along the second conveyor 8.

In more detail, the third moving unit 10 comprises a respective handling unit and an articulated robotic arm. The handling unit is mounted to the free end of the articulated robotic arm and is configured to pick up rows of containers of the plurality of containers 2 (for example, 3 bottles at a time) from the first conveyor 8 to arrange them already aligned along the second conveyor 9.

In a further embodiment, not shown in the figures, the first conveyor means 1 of the plurality of containers 2 may comprise a conveyor configured to convey each container of the plurality of containers 2 with a rhythmic pace. In such an embodiment, the loading of the containers in the inlet zone Z1 of the system 100 does not occur by grouping them in boxes or cartons, but by loading one at a time the containers of the plurality of containers 2 already aligned with one another.

According to one embodiment, shown in the figures, in combination with those described above, the system 100 may comprise a closure unit 11 of the containers, configured to apply the respective closure element, i.e. a cap, a lid, a capsule and so on, as already defined above, to each container.

The closure unit 11 of the containers is operatively associated with the first conveyor means 1 of containers, therefore arranged between the inlet zone Z1 of the system 100 and the sealing zone Z2 of the containers.

In particular, in the embodiment of the figures, the closure unit 11 of the containers is operatively associated with the second conveyor 9 so that it may apply the closure element to the respective container when the containers of the plurality of containers 2 are already in a row aligned with one another.

According to a further embodiment, not shown in the figures, the system 100 may lack the closure unit 11 of the containers. In this case, each container of the plurality of containers 2 is already equipped with the closure element at the time of loading in the inlet zone Z1 of the system 100.

According to one embodiment, shown in the figures, the system 100 further comprises a first orientation unit 12 of containers, operatively associated with the first conveyor means 1 of containers.

Figure 2:
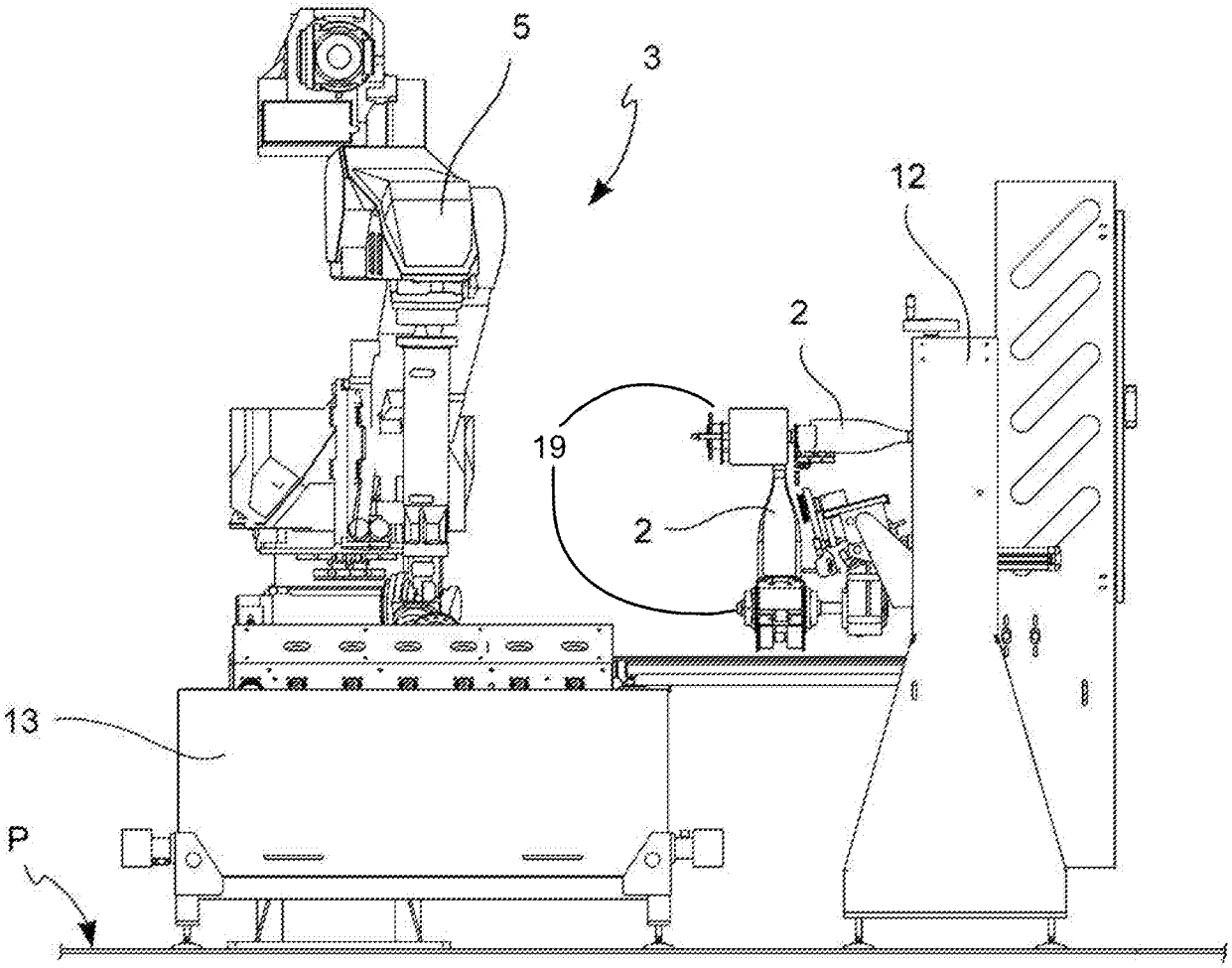
FIG. 2 diagrammatically shows a side view of a portion of the system in FIG. 1.
Figure 3:
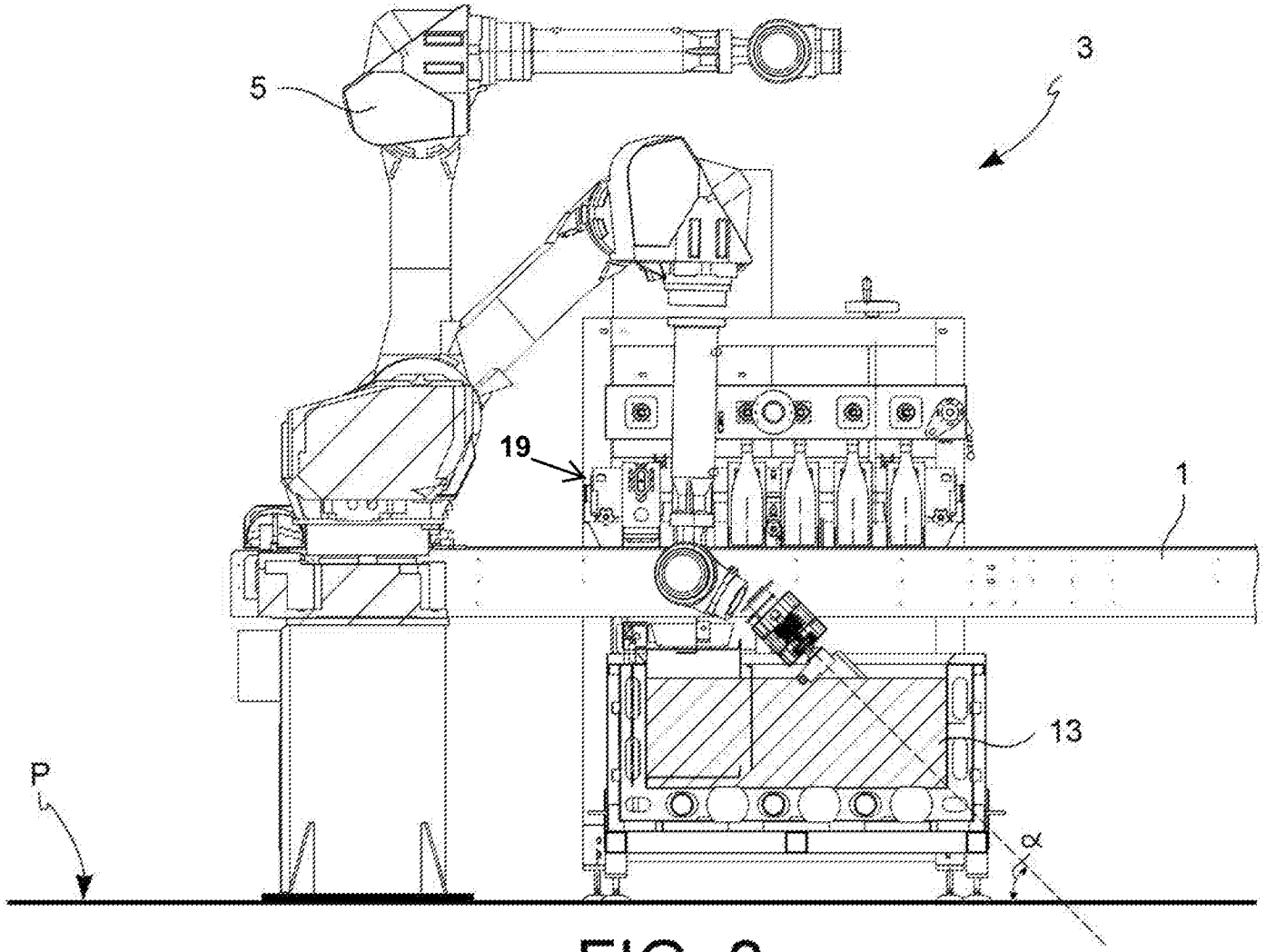
FIG. 3 diagrammatically shows a sectional view of the portion of the system depicted in FIG. 2.
Figure 4:
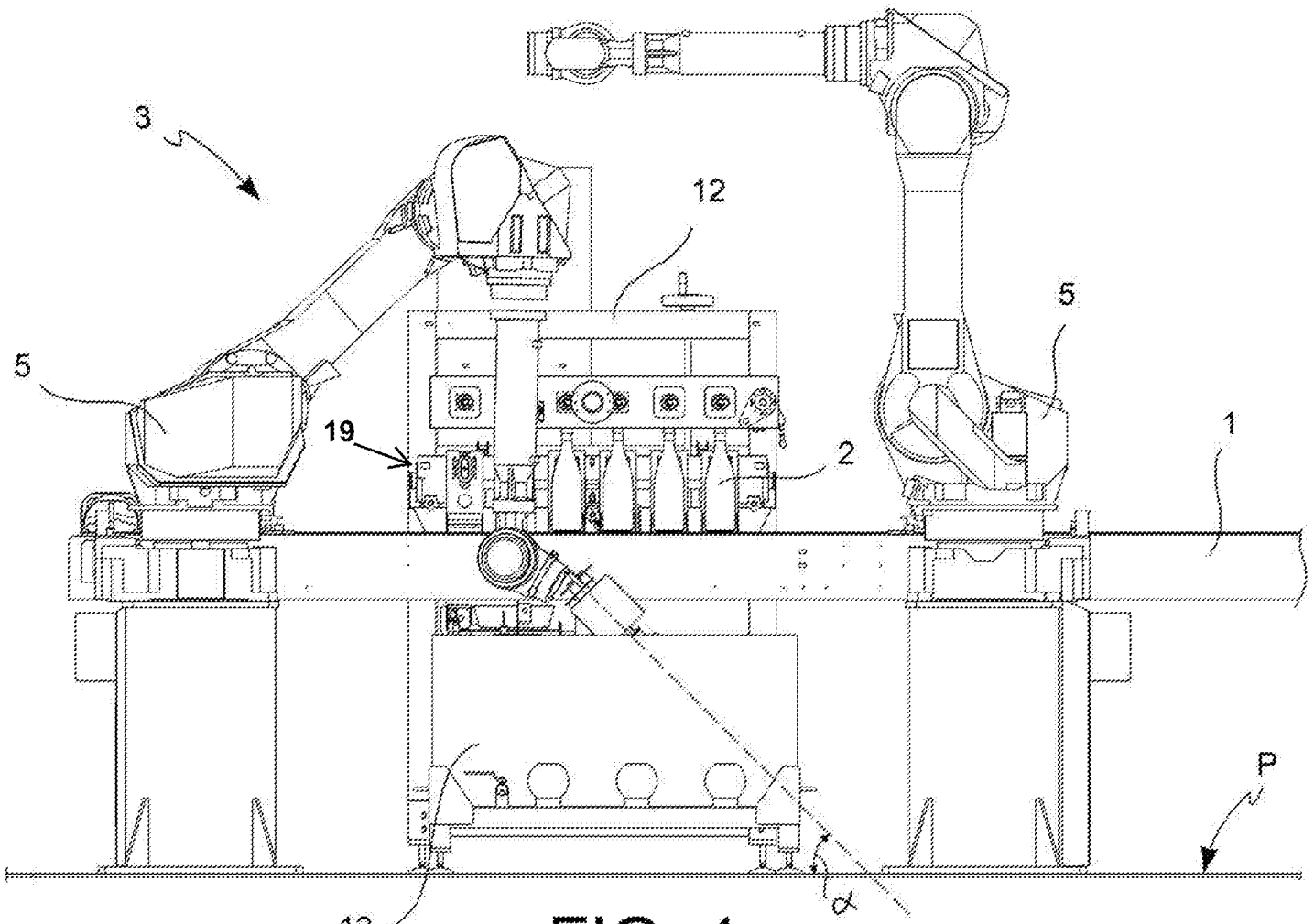
FIG. 4 diagrammatically shows a front view of the portion of the system depicted in FIG. 2.

The first orientation unit 12 of containers includes a container rotation assembly 19 shown in FIGS. 2-4, which is configured to pick up a plurality of containers 2 from the first conveyor means 1 of containers and orient such a plurality of containers 2 so that at least one end portion of each container in which a closure element (cap, lid, capsule and so on) is present faces downwards.

In one embodiment, in combination with the previous one, the first processing station 3 further comprises a containment tank 13 of sealing material in the molten state.

In this embodiment, the first moving unit 5 is configured to pick up a plurality of oriented containers (for example six containers) from the first orientation unit 12 of containers.

The first moving unit 5 is further configured to further orient the plurality of containers 2 picked up by the first orientation unit 12 so that the longitudinal axis of each container is inclined by a predetermined inclination angle $\alpha$ with respect to a reference plane P, such as the floor on which the system 100 lays (as shown in FIGS. 3 and 4).

The predetermined inclination angle $\alpha$ is in the range from 30° to 90° with respect to the reference plane P, for example, or is preferably of 45° with respect to the reference plane P.

The first moving unit 5 is also configured to immerse the at least one end portion of each container of the plurality of containers 2 picked up by the first orientation unit 12 in the containment tank 13 of sealing material in the molten state, while maintaining the predetermined inclination angle $\alpha$ of the longitudinal axis of each container with respect to the reference plane P.

It is worth noting that, in one embodiment, the first moving unit 5 is configured to immerse the at least one end portion of each container of the plurality of containers 2 picked up by the first orientation unit 10 in the containment tank 13 of sealing material in the molten state without rotating any container with respect to its longitudinal axis.

The immersion of each container in the sealing material in the molten state without rotating each container about its rotation axis advantageously allows to obtain a layer of sealing material having a tapered shape of the drip- or tie-type about the at least one end portion of the container, thus having an aesthetic shape which is still acceptable but with a saving in sealing material, costs and production times.

Returning to the embodiment of the figures and in particular to the second processing station 4, the latter comprises a cooling tank 14.

The cooling tank 14 comprises a cooling liquid therein, for example water at room temperature or at any other temperature which is suitable for cooling.

In this embodiment, the first moving unit 5 is also configured to extract the plurality of containers 2 from the containment tank 13 of molten sealing material, and immerse, in the cooling tank 14, at least the end portion (to which the layer of sealing material is applied) of each container of the plurality of containers 2 picked up from the containment tank 13 of sealing material in the molten state.

Figure 5:
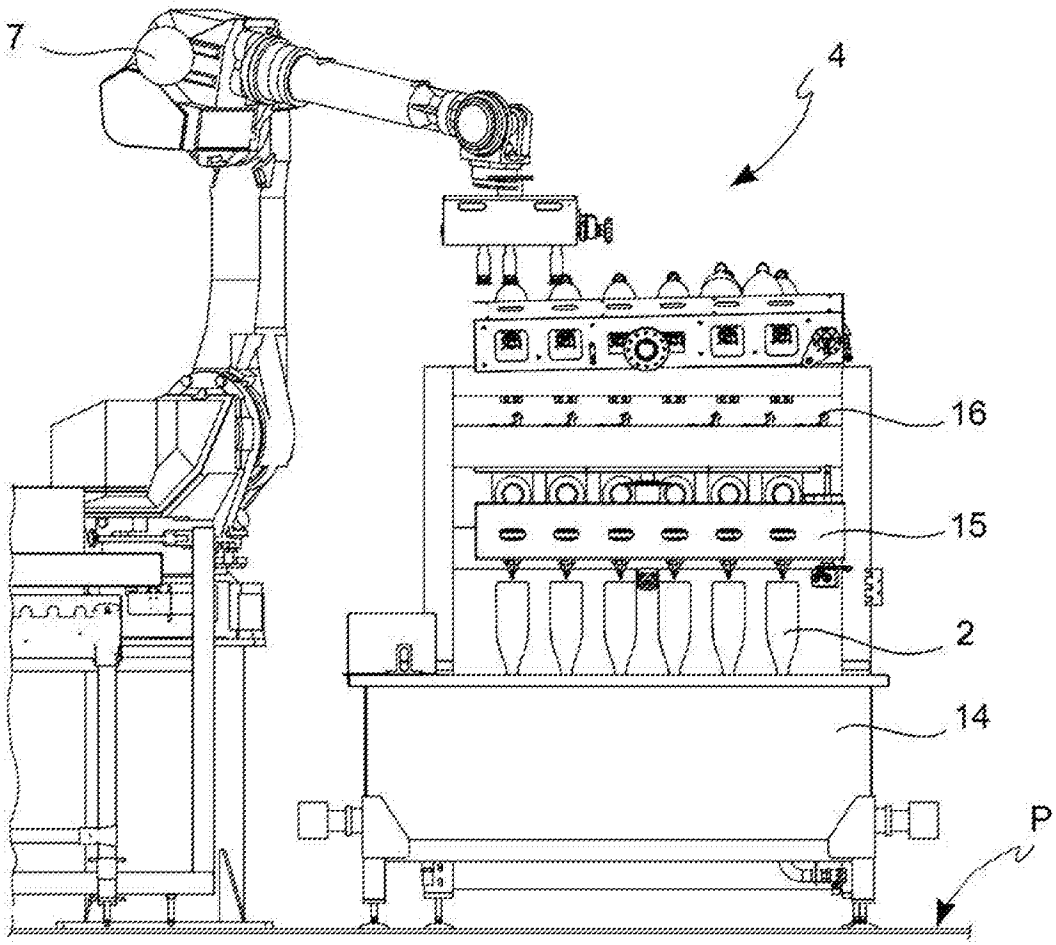
FIG. 5 diagrammatically shows a side view of a further portion of the system in FIG. 4 in an operating configuration.
Figure 6:
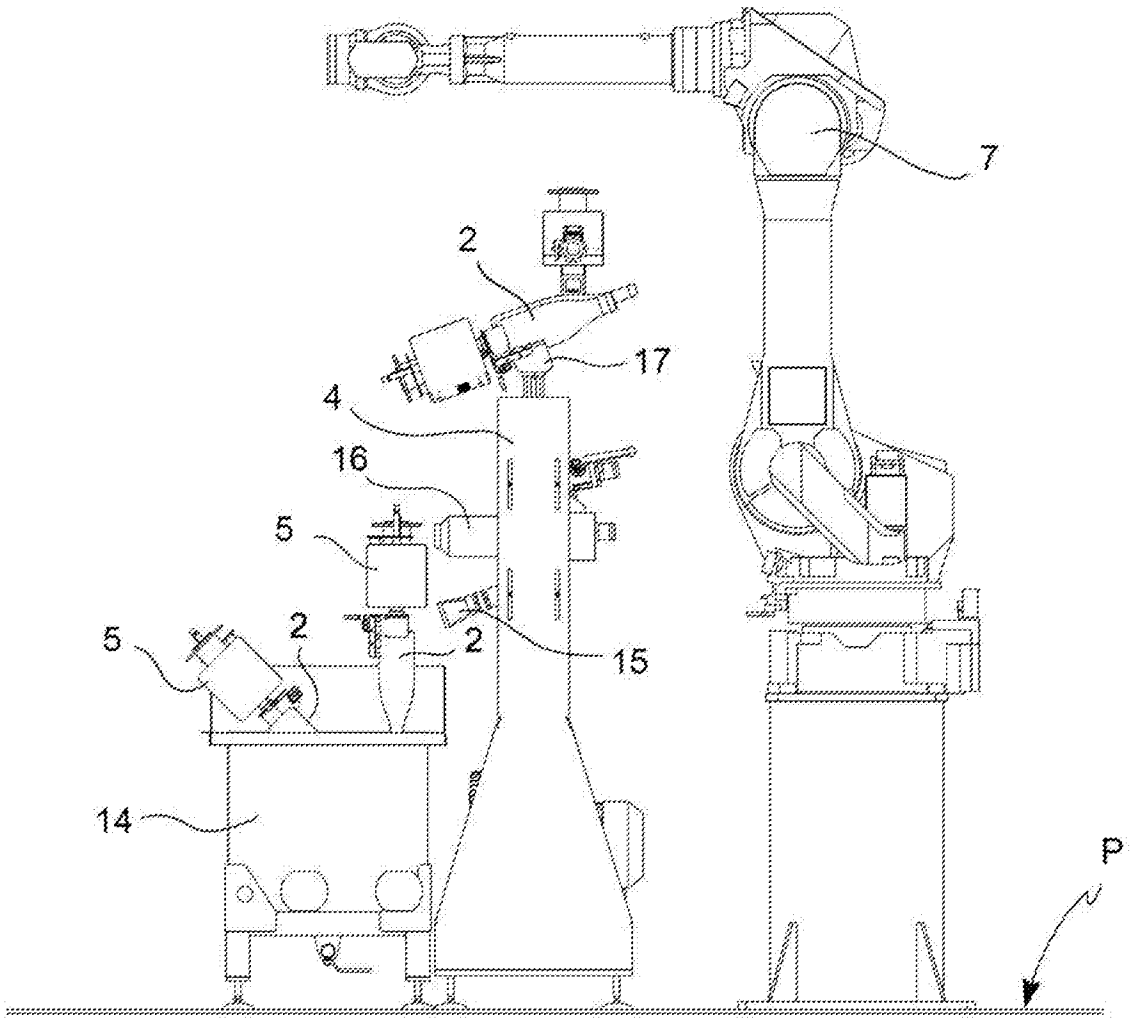
FIG. 6 diagrammatically shows a side view of the further portion of the system in FIG. 5 in a further operating configuration.

In one embodiment, with particular reference to FIGS. 5 and 6, the second processing station 4 further comprises a first polishing unit 15 and a second polishing unit 16.

In this embodiment, the first moving unit 5 is configured to pass the plurality of containers 2 extracted from the cooling tank 14 in the first polishing unit 15 and then in the second polishing unit 16.

It is worth noting that the passage of the plurality of containers 2 extracted from the cooling tank 14 in the first polishing unit 15 and then in the second polishing unit 16 may be performed, in one embodiment, with a stop-free passage or, in a further embodiment, with a stop in the first polishing unit 15 and a stop in the second polishing unit 16.

In particular, the first polishing unit 15 is adapted to subject the layer of sealing material of each container of the plurality of containers 2 extracted from the cooling tank 14 to a cold air flow, for example at room temperature or at any other suitable temperature.

The second polishing unit 16 is adapted to subject the layer of sealing material of each container of the plurality of containers 2 subjected to the cold air flow by the first polishing unit 15 to a hot air flow, for example at a temperature of 150°-200° C.

In this regard, it is worth noting that, in one embodiment (shown in the figures), the first polishing unit 15 comprises a first plurality of nozzles each adapted to provide a cold air flow which hits the layer of sealing material of each container of the plurality of containers 2 picked up from the first moving unit 5.

In an embodiment alternative to the previous one (not shown in the figures), the first polishing unit 15 comprises a single nozzle adapted to provide the cold air flow which hits the layer of sealing material of each container of the plurality of containers 2 picked up from the first moving unit 5.

It is worth noting that, in one embodiment (shown in the figures), the second polishing unit 16 comprises a second plurality of nozzles each adapted to provide a hot air flow which hits the layer of sealing material of each container of the plurality of containers 2 moved by the first moving unit 5.

In an embodiment alternative to the previous one (not shown in the figures), the second polishing unit 16 comprises a single nozzle adapted to provide the hot air flow which hits the layer of sealing material of each container of the plurality of containers 2 moved by the first moving unit 5.

It is worth noting that subjecting the layer of sealing material of each container to a cold air flow advantageously allows to remove the residues of cooling liquid (for example, drips of water) of the cooling tank 12, while then subjecting the layer of sealing material of each container to a hot air flow advantageously allows to improve the sheen of the layer of sealing material itself, thus the aesthetic appearance of the sealed container.

Returning to the embodiment of the figures, it is worth noting that the first moving unit 5 is also configured to rotate each container of the plurality of containers 2 about the respective longitudinal axis when the plurality of containers 2 extracted from the cooling tank 14 passes in the first polishing unit 15 and in the second polishing unit 16.

Thereby, the action of the first polishing unit 15 and of the second polishing unit 16 can be obtained in a uniform manner over the entire surface of the end portion of each container to which the layer of sealing material is applied.

With reference to the embodiment of the figures, in particular to FIG. 6, it is worth noting that the second processing station 4 further comprises a storage unit 17 of containers of the plurality of containers 2, on the at least one end portion of which the layer of sealing material applied has been polished.

In the embodiment of the figures, the second processing station 4 extends substantially vertically with respect to the reference plane P in the following order, starting from the bottom, first polishing unit 15, second polishing unit 16, and storage unit 17 of containers (FIG. 6).

The first moving unit 5 is configured to store, in the storage unit 17, the plurality of containers 2 passed in the first polishing unit 15 and then in the second polishing unit 16.

In this embodiment, such a storage unit 17 comprises a plurality of housings, each of which is adapted to receive a container of the plurality of containers 2 stored by the first moving unit 5.

Again in this embodiment, the second moving unit 7 of the system 100 is also configured to pick up the plurality of containers 2 stored by the first moving unit 5 from the storage unit 17 of the second processing station 4, and transfer such a plurality of containers 2 to the second conveyor means 6 of containers of the system 100.

Returning to the second conveyor means 6 of containers, in the embodiment of the figures, they comprise a further conveyor 18, for example a roller set or a conveyor belt, configured to convey a plurality of containers 2 divided in groups from the sealing zone Z2 of containers, each preferably accommodated within a respective box or carton.

In the embodiment of the figures, it is further worth noting that the system 100 comprises a further moving unit 5' of containers, hereinafter also only referred to as a further moving unit, configured to move, alternately to the first moving unit 5, a plurality of containers 2 from said first conveyor means 1 of containers to the first processing station 3, and move, alternately to the first moving unit 5, a plurality of containers 2 from the first processing station 3 to the second processing station 4, to the at least one end portion of which the layer of sealing material has been applied.

In particular, the further moving unit 5' is configured to move the plurality of containers within the first processing station 3 and the second processing station 4 in the same manner as the first moving unit 5. Therefore, for conciseness, the configuration of the further moving unit 5' is not repeated here.

It is worth noting that, in one alternative embodiment, the system 100 may lack the further moving unit 5'.

Returning to the embodiment of the figures, as already mentioned above for the third moving unit 10, the first moving unit 5, the second moving unit 7 and the further moving unit 5' also comprise a respective handling unit and an articulated robotic arm, in which the handling unit is mounted to the free end of the articulated robotic arm.

It is worth noting that the handling unit of the first moving unit 5 and of the further moving unit 5' comprise gripping elements (e.g. suction cups, clamps, jaws, and so on) for gripping each container from the side opposite to the end portion subjected to processing so that such an end portion is free.

In particular, each gripping element can act on the bottom or on the lateral side, close to the bottom, of the container.

It is also worth noting that the handling units of the first moving unit 5 and of the further moving unit 5' are configured to rotate the gripping elements so that the respective container gripped rotates about its longitudinal axis.

The handling unit of the second moving unit 7 and of the third moving unit 10 comprise gripping elements (e.g. suction cups, clamps, jaws, and so on) for gripping each container from the end portion subjected to processing so that the bottom of the container, opposite to the end portion, is free so that the container is picked up from or inserted in a support plane, such as a conveyor, a bottom of a box or carton, and so on.

Finally, it is worth noting that the operation of the system 100 is obtained by means of program codes loadable on a memory and executable by a data processing unit of an electronic computer, such as a PLC, operatively associated with each of the components of the system 100 described above, i.e. the moving units 5, 5' (if present), 7, 10 of containers, the conveyor means 1, 6 of containers, the orientation unit 12 of containers, the closure unit 11 of containers (if present), and so on.

It is worth noting that the electronic computer may be one for all the above components or a dedicated electronic computer for each of such components.

Figure 7:
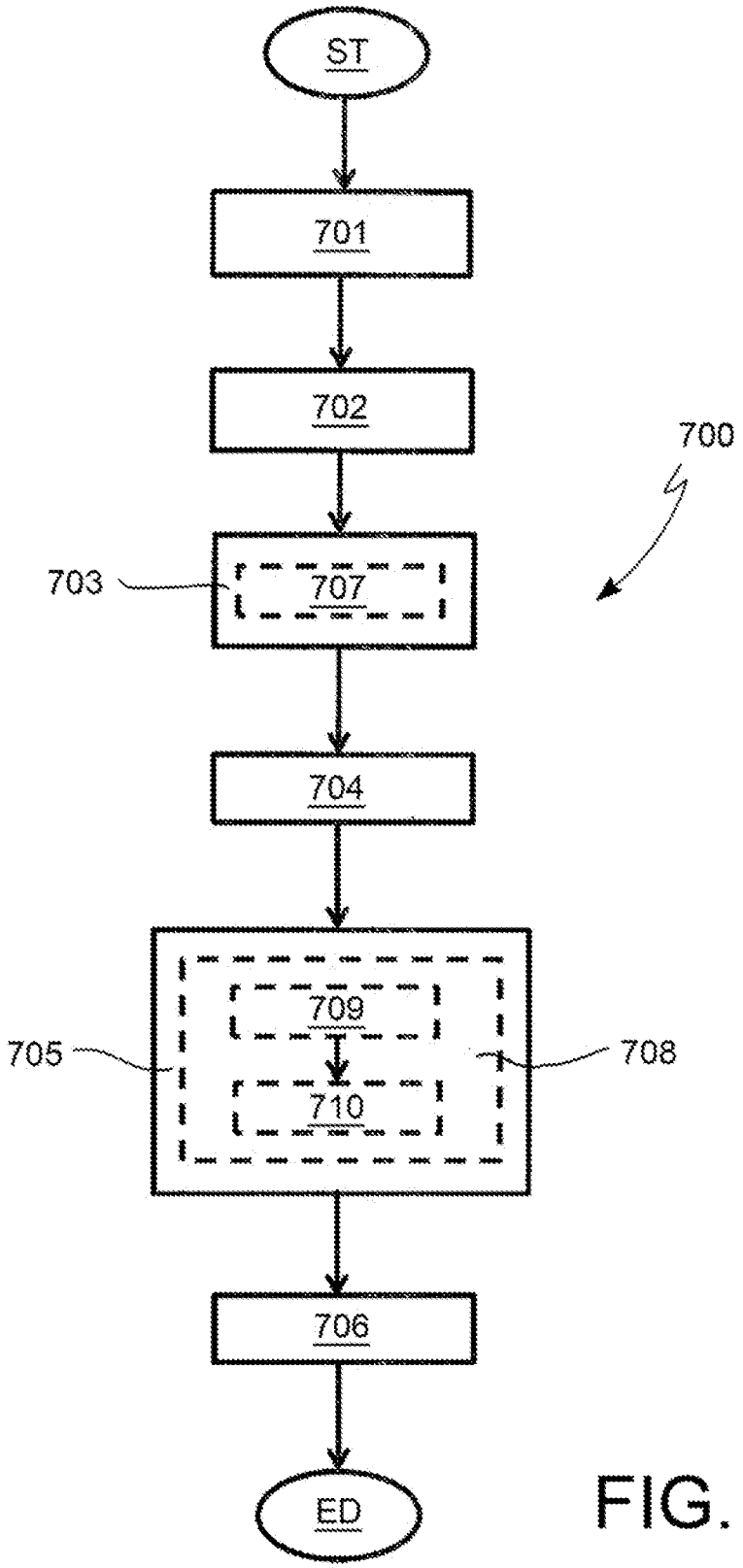
FIG. 7 shows, by means of a block diagram, a method of sealing containers, bottles, flasks and the like, according to one embodiment of the invention.

With reference now to FIG. 7, it is now described a method 700 of sealing containers, bottles, flasks, and the like, also simply referred to as a method below, according to one embodiment of the present invention.

The method 700 comprises a symbolic step of starting ST.

The method 700 comprises a step of conveying 701, by first conveyor means 1 of containers, the containers from an inlet zone Z1 to a sealing zone Z2 of containers.

The first conveyor means 1 have already been described above.

The method 700 further comprises a step of moving 702, by a first moving unit 5 of containers, a plurality of containers 2 from the first conveyor means 1 of containers to a first processing station 3 of containers.

The first moving unit 5 of containers and the first processing station 3 of containers have already been described above.

The method 700 further comprises a step of applying 703, by the first processing station 3 of containers, a layer of sealing material to at least one end portion of each container of the plurality of containers 2.

The method 700 further comprises a step of moving 704, by the first moving unit 5 of containers, from the first processing station 3 of containers to a second processing station 4 of containers, a plurality of containers 2, to the at least one end portion of which a layer of sealing material has been applied.

The second processing station 4 of containers has already been described above.

Furthermore, the method 700 comprises a step of polishing 705, by the second processing station 4 of containers, the layer of sealing material applied by the first processing station 3 of containers to said at least one end portion of each container of the plurality of containers 2.

The method 700 further comprises a step of moving 706, by the second conveyor means 6 of containers, a plurality of containers from the second processing station 4 of containers to an outlet zone Z3, on the at least one end portion of which a layer of sealing material applied has been polished.

The second conveyor means 6 have already been described above.

The method 700 comprises a symbolic step of ending ED.

In one embodiment, the step of applying 703 comprises a step of immersing 707, by the first moving unit 5 of containers, at least one end portion of each container of the plurality of containers 2 picked up from a first orientation unit 12 in a containment tank 13 of sealing material in the molten state, maintaining a predetermined inclination angle $\alpha$ of the longitudinal axis of each container with respect to a reference plane P.

The first orientation unit 12 of containers and the containment tank 13 of sealing material have been described above.

In one embodiment, alternative to or in combination with the previous one, the step of polishing 705 comprises a step of passing 708, by the first moving unit 5 of containers, a plurality of containers 2 extracted from a cooling tank 14 of the second processing station 4 in a first polishing unit 15 and then in a second polishing unit 16 of the second processing station 4 of containers.

It is worth noting that the layer of sealing material, once a container has been extracted from the containment tank, already hardens upon contact with air at room temperature.

The step of passing 708 comprises steps of:

subjecting 709, by the first polishing unit 15, the layer of sealing material of each container of the plurality of containers 2 extracted from the cooling tank 14 to a cold air flow;

subjecting 710, by the second polishing unit 16, the layer of sealing material of each container of the plurality of containers 2 subjected to the cold air flow by the first polishing unit 15 to a hot air flow.

As can be seen, the object of the invention is achieved as the above-described system and method of sealing containers have several advantages.

First, the system allows to process (immersion into the sealing material and polishing) more than one container simultaneously, ensuring an optimization of times and a reduction in processing costs.

Moreover, moving a plurality of containers with the same handling unit allows to ensure the same level of immersion within the containment tank of sealing material. This allows to distribute the sealing material substantially in the same manner on each container.

Furthermore, simultaneously subjecting more containers to the cold air flow and then to the hot air flow advantageously allows to obtain a uniform and substantially equal polishing on all containers.

In addition, the fact that the moving units are configured to perform the movement of the containers in the same manner on all the containers loaded in the inlet zone of the system advantageously allows to seal the containers substantially in the same manner, thus ensuring uniformity of the sealed containers.

In order to fulfill contingent needs, those skilled in the art will be able to make changes and adaptations to the embodiments of the system and method described above, and replacements of elements with others functionally equivalent, without departing from the scope of the following claims. Each of the features described as belonging to a possible embodiment can be achieved irrespective of other embodiments described.

The invention claimed is:

1. A system for sealing containers, comprising:

a first conveyor assembly configured for conveying a plurality of containers from an inlet zone to a sealing zone;

a first processing station configured for applying a layer of sealing material to at least one end portion of each container of said plurality of containers;

a second processing station configured for polishing the layer of sealing material applied by the first processing station to said at least one end portion of each container of the plurality of containers provided by the first conveyor assembly;

a first moving unit for moving a plurality of containers from said first conveyor assembly to the first processing station, the first moving unit being configured for moving a plurality of containers from the first processing station to the second processing station on the at least one end portion of which a layer of sealing material has been applied;

a second conveyor assembly for conveying a plurality of containers from the sealing zone to an outlet zone of the system;

a second moving unit configured for moving a plurality of containers from the second processing station to the second conveyor assembly on the at least one end portion of which the layer of sealing material applied has been polished;

wherein the first conveyor assembly comprises:

a first roller set or a first conveyor belt configured to convey a plurality of containers divided into groups from the inlet zone;

a rhythmic pace conveyor configured to convey each of the containers of the plurality of containers toward the sealing zone at a rhythmic pace;

a third moving unit configured to pick up the plurality of containers from the first roller set or the first conveyor belt and arrange the containers of the plurality of containers in a row along the rhythmic pace conveyor.

2. A system according to claim 1, further comprising a first orientation unit operatively associated with the first conveyor assembly, the first orientation unit comprising a container rotation assembly configured for picking up the plurality of containers from the first conveyor assembly and orienting the plurality of containers so that at least one portion of each container in which a closure element is present is facing downwards.

3. A system according to claim 2, wherein the first processing station comprises a containment tank of sealing material in a molten state, the first moving unit being configured for picking up the plurality of oriented containers from the first orientation unit, the first moving unit being further configured for further orienting the plurality of containers picked up from the first orientation unit in such a way that a longitudinal axis of each container is inclined by a predetermined inclination angle with respect to a reference plane, the first moving unit being further configured for immersing the at least one end portion of each container of the plurality of containers picked up by the first orientation unit in the containment tank of sealing material in the molten state, while keeping the predetermined inclination angle of the longitudinal axis of each container with respect to the reference plane.

4. A system according to claim 3, wherein the predetermined inclination angle is in the range from 30° to 90° with respect to the reference plane.

5. A system according to claim 3, wherein the predetermined inclination angle with respect to the reference plane is 45°.

6. A system according to claim 3, wherein the second processing station comprises a cooling tank, the first moving unit being configured for extracting the plurality of containers from the containment tank of molten sealing material and immersing at least the end portion of each container of the plurality of containers picked up from the containment tank of molten sealing material into the cooling tank.

7. A system according to claim 6, wherein the second processing station further comprises a first polishing unit and a second polishing unit, the first moving unit being configured for passing the plurality of containers extracted from the cooling tank into the first polishing unit and then into the second polishing unit.

8. A system according to claim 7, wherein the first polishing unit is adapted to subject the layer of sealing material of each container of the plurality of containers extracted from the cooling tank to a cold air flow, the second polishing unit being adapted to subject the layer of sealing material of each container of the plurality of containers subjected to the cold air flow by the first polishing unit to a hot air flow.

9. A system according to claim 7, wherein the first moving unit is also configured for rotating each container of the plurality of containers about the respective longitudinal axis during passage of the plurality of containers extracted from the cooling tank in the first polishing unit and in the second polishing unit.

10. A system according to claim 7, wherein the second processing station comprises a storage unit on the at least one end portion of which the layer of sealing material applied has been polished, the first moving unit being configured for depositing the plurality of containers passed in the first polishing unit and in the second polishing unit in the storage unit.

11. A system according to claim 10, wherein the second moving unit is configured for picking up the plurality of containers stored by the first moving unit from the storage unit of the second processing station and transferring the plurality of containers on the second conveyor assembly.

12. A system according to claim 10, wherein the second processing station extends substantially vertically with respect to the reference plane in the following order, starting from the bottom: first polishing unit, second polishing unit, and storage unit of containers.

13. A system according to claim 1, wherein the first moving unit, the second moving unit, and the third moving unit each comprise a respective handling unit and a respective articulated robotic arm, wherein the handling unit is mounted on the free end of the articulated robotic arm.

14. A system according to claim 13, wherein the handling unit of the first moving unit comprises gripping elements for gripping each container from the side opposite to the end portion subjected to processing so that the end portion is free.

15. A system according to claim 13, wherein the handling unit of the second moving unit comprises gripping elements for gripping each container by the end portion subjected to processing so that the bottom of the container, opposite the end portion, is free so that the container is picked up from or inserted on a support plane.

16. A system according to claim 14, wherein the handling unit of the first moving unit is configured for rotating the gripping elements in such a way that the respective container picked up rotates about the longitudinal axis of the container.

17. A system according to claim 1, further comprising a closure unit configured to apply a respective closure element to each container, the closure unit being arranged between the inlet zone of the system and the sealing zone of the containers.

18. A system according to claim 17, wherein the closure unit is operatively associated with the rhythmic pace conveyor so that the closure unit applies a closure element to the respective container when the containers of the plurality of containers are already in a row aligned with one another.

19. A system according to claim 1, comprising a further moving unit of containers, configured to move, alternately to the first moving unit, a plurality of containers from said first conveyor assembly to the first processing station, and move, alternately to the first moving unit, a plurality of containers from the first processing station to the second processing station, to the at least one end portion of which the layer of sealing material has been applied.

* * * * *